United States Patent [19]

Bartholomew

[11] 4,257,192

[45] Mar. 24, 1981

[54] WINDOW REGULATOR AND DRIVE ASSEMBLY

[75] Inventor: Donald D. Bartholomew, Marine City, Mich.

[73] Assignee: Merit Plastics, Inc., East Canton, Ohio

[21] Appl. No.: 9,607

[22] Filed: Feb. 5, 1979

Related U.S. Application Data

[62] Division of Ser. No. 877,264, Feb. 13, 1978, Pat. No. 4,182,078.

[51] Int. Cl.[3] ..... E05F 15/00

[52] U.S. Cl. ..... 49/140; 74/625

[58] Field of Search ..... 49/139, 140; 74/625; 192/95

[56] References Cited

U.S. PATENT DOCUMENTS

| | | | |
|---|---|---|---|
| 2,621,543 | 12/1952 | Rossmann | 49/140 X |
| 2,621,544 | 12/1952 | Rossmann | 49/140 X |
| 2,718,395 | 9/1955 | Ehrlich | 74/625 |
| 3,292,453 | 12/1966 | Recknagel | 74/625 |
| 3,742,781 | 7/1973 | Boyriven | 74/625 |

*Primary Examiner*—Philip C. Kannan

*Attorney, Agent, or Firm*—Harness, Dickey & Pierce

[57] ABSTRACT

There is disclosed herein an automotive window regulator and drive mechanism which includes a rotatable flexible drive shaft to transmit rotational forces from the regulator arm to a worm gear supported on a lower edge of the window. The worm gear engages a rack secured to a portion of the vehicle so as to vary the position of the window. In one embodiment, both electric motor drive and manual crank drive means are provided either of which may be selectively engaged to drive the rotatable flexible shaft. The regulator end of the flexible drive shaft may be supported in meshing engagement with a portion of the regulator drive gear by means of a pinion pivot arm which arm includes indexing gears to enable the flexible cable to track the worm gear thereby reducing the flexing of the flexible drive shaft.

12 Claims, 14 Drawing Figures

FIG. 4.
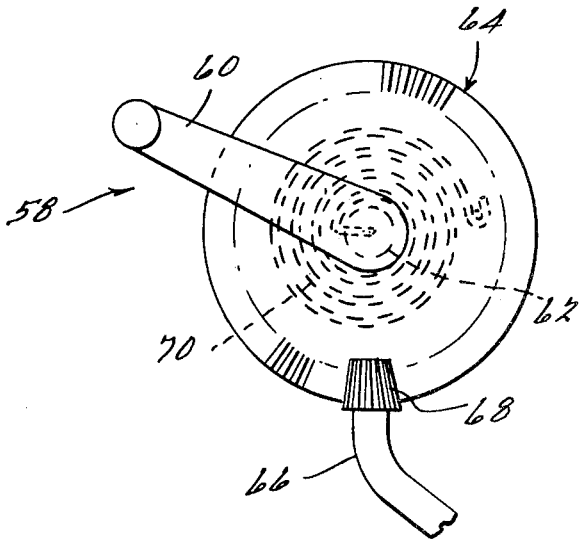
FIG. 6.
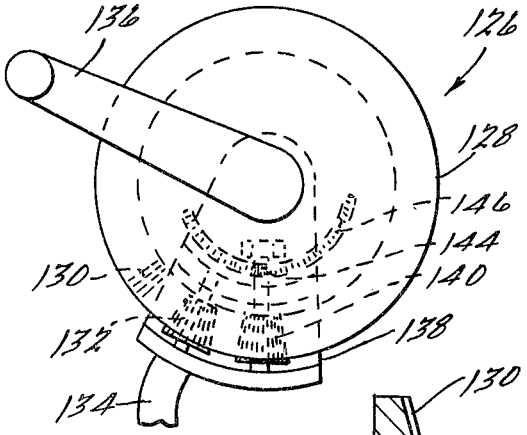
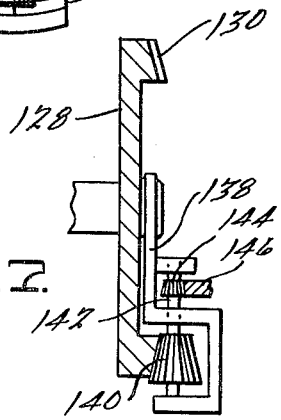
FIG. 7.
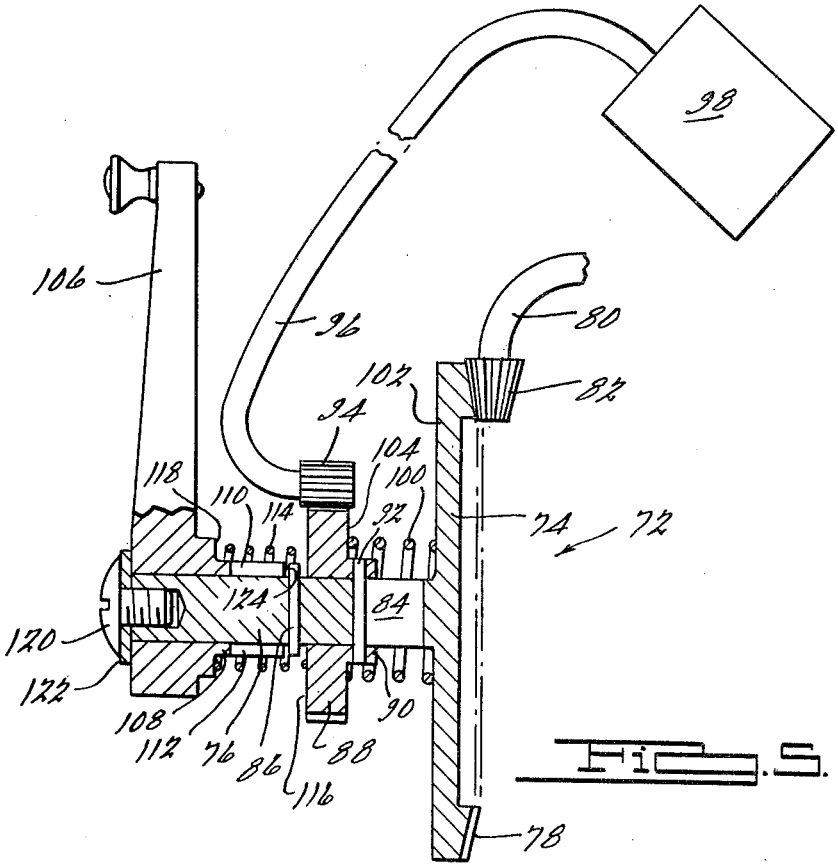
FIG. 5.

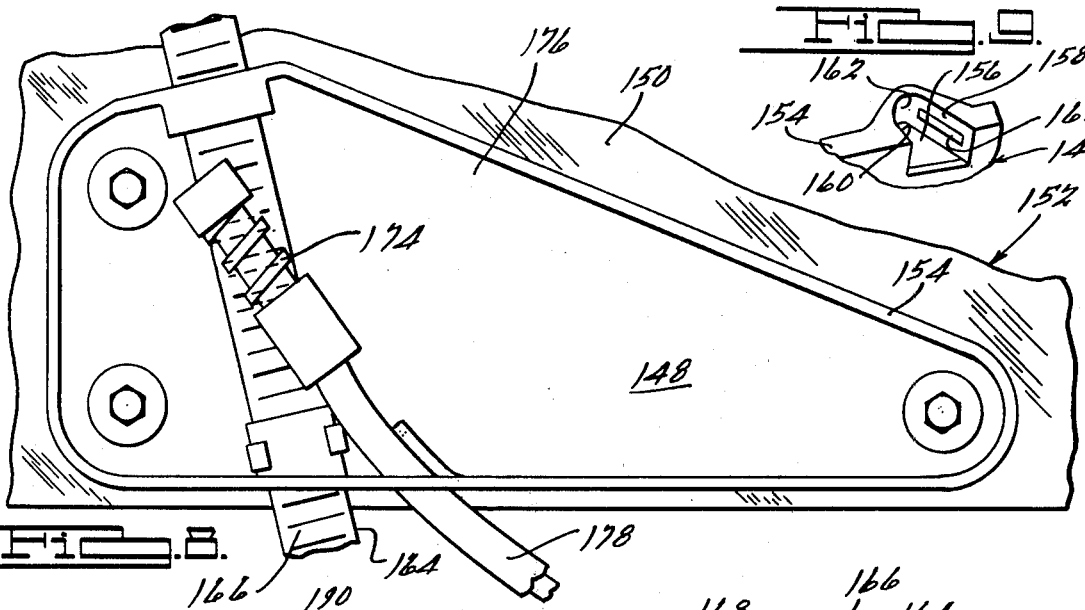
Fig. 8.
Fig. 9.
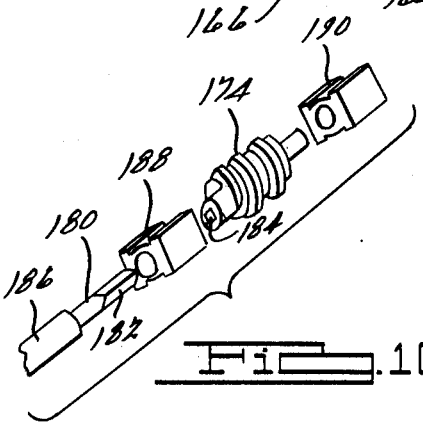
Fig. 10.
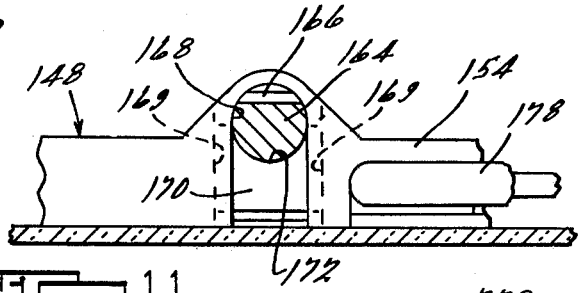
Fig. 11.
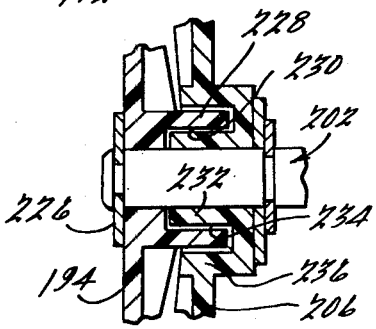
Fig. 13.
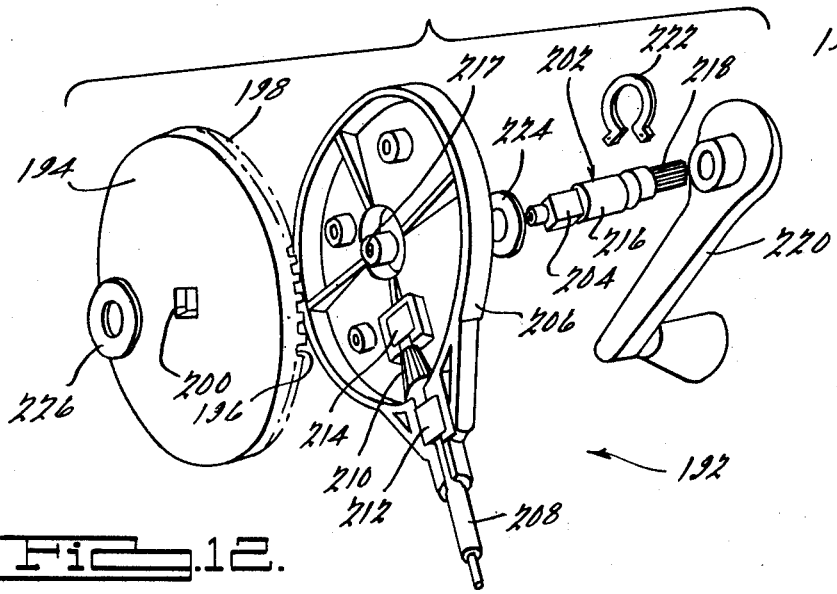
Fig. 12.

WINDOW REGULATOR AND DRIVE ASSEMBLY

This is a division of application Ser. No. 877,264, filed Feb. 13, 1978 now U.S. Pat. No. 4,182,078.

Background and Summary of the Invention

The present invention relates generally to window regulators and associated drive mechanisms and more particularly to such regulator and drive mechanisms which are particularly suited for use in motor vehicles.

Various arrangements of automotive window regulator and drive arrangements have been developed over the years. These arrangements vary widely from complex lever arm and gear configurations to rack and pinion type drive arrangements. However, most of these arrangements employ numerous parts which may differ for each model of vehicle and must each be manufactured, handled, assembled and stocked all of which contributes to increasing the cost of such mechanisms. Further, when electrically operated window drives are desired, it may be necessary to install a totally different operating mechanism. Also, with respect to electrically operated windows, the mechanical operators are generally totally deleted thereby requiring complete reliance upon the operability of the electrical system. Should a failure be encountered when the window is in a lowered position, rain, snow or other elements may cause damage to the vehicle interior. Additionally, as gasoline prices and governmental pressure for greater fuel economy in vehicles continue to increase, automobile manufacturers are vigorously seekings ways to reduce the weight of the vehicle through whatever possible means may be available.

Accordingly, the present invention provides an extremely simple window regulator and drive mechanism which requires a minimum number of parts, the majority of which may be standardized for numerous makes and models of vehicles. The reduced number of parts as well as the simplicity of the overall arrangement make the present invention particularly desirable for not only may the weight be reduced but assembly time and costs as well as repair time and costs may be significantly reduced. Further savings may be achieved in that the present invention utilizes a flexible shaft to transmit rotary motion from the regulator to the window thereby enabling standardized parts to be installed in varying locations of numerous vehicles. Such standardization is particularly desirable in reducing inventory investment and control as well as the number of spare parts required to be stocked.

Additionally, the present invention may be readily adapted for use with electrically operated windows with a minimum of additional parts. Also, if desired, the regulator may include manual override means thereby enabling the user to operate the window even in the event of electrical failure, depleted battery or the like.

Additional advantages and features of the present invention will become apparent from the subsequent description and the appended claims taken in conjunction with the accompanying drawings.

BRIEF DESCRIPTION OF THE DRAWINGS

FIG. 4 is a detail view of the regulator and associated drive mechanism in accordance with the present invention;

FIG. 5 is an elevational view of another embodiment of a drive mechanism having both manual and electric modes of operation, portions thereof being shown in section;

FIG. 6 is a view of a regulator mechanism similar to that of FIG. 4 although embodying a pinion pivot arm arrangement in accordance with the present invention;

FIG. 7 is a sectional view of the embodiment of FIG. 6, the section being taken along a radial plane extending parallel to the axis of rotation of the regulator;

FIG. 8 is an elevational view similar to that of FIG. 2 but illustrating another embodiment of window drive means and associated guide members;

FIG. 9 is a detail view of a portion of the guide member illustrated in FIG. 8;

FIG. 10 is an exploded perspective view of the worm gear drive assembly illustrated in FIG. 8;

FIG. 11 is a bottom plan view of a portion of the guide member illustrated in FIG. 8;

FIG. 12 is an exploded perspective view of yet another embodiment of a regulator means in accordance with the present invention; and FIG. 13 is a fragmentary view of a portion of the window regulator means of FIG. 12, the section being taken along a radial plane passing through the rotational axis thereof.

DESCRIPTION OF THE PREFERRED EMBODIMENTS

Figure 1:
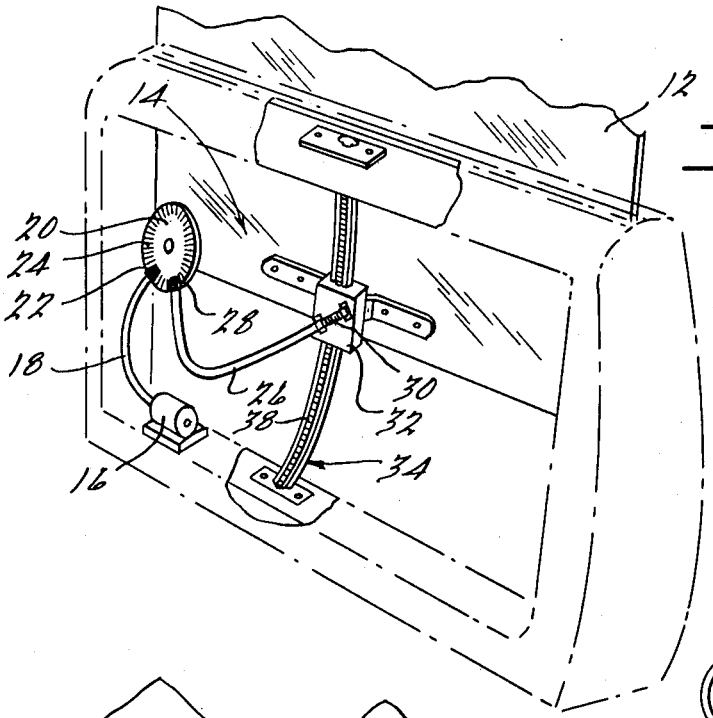
FIG. 1 is perspective view of a conventional motor vehicle door having a window regulator and drive mechanism in accordance with the present invention installed in operative relationship thereto.

Referring now to the drawings and in particular to FIG. 1, there is illustrated a conventional motor vehicle door 10 having a window 12 movably installed therein and associated regulator and drive mechanism 14 in accordance with the present invention shown in operative relationship thereto. Door 10 is illustrated herein with the interior panel and portions of interior frame members removed therefrom for clarity.

Window regulator and drive mechanism 14 comprises a reversible electric motor 16 which may be secured in any suitable out of the way location within door 10 and has a flexible drive shaft 18 extending to a ring gear 20. Flexible drive shaft 18 has a pinion gear 22 secured to the end thereof in meshing and driving engagement with teeth 24 provided around the periphery of ring gear 20. Ring gear 20 may similarly be mounted in any suitable out of the way location within door 10 but will generally be appropriately positioned so as to enable it to be provided with regulator crank handle should a manually operable window regulator and drive arrangement be desired or should a dual mode arrangement as disclosed below be desired.

A second flexible drive shaft 26 is also provided having a pinion gear 28 provided on one end thereof in meshing engagement with teeth 24 of ring gear so as to be driven thereby and another end having a worm gear 30 secured thereto. Worm gear 30 is secured and rotatably supported on a guide member 32 at an oblique angle relative thereto.

A vertically extending rack 34 is also provided having upper and lower ends secured to portions of door 10 at a point approximately midway along the length of the window and slightly inboard thereof. Rack 34 is generally oval in shape having an embossed inwardly facing portion 36 provided with teeth 38, generally arcuate shaped opposed sidewalls 40 and 42 and a pair of relatively flat rear wall portions 44 and 46 defining a longitudinally extending slot 48 therebetween.

As mentioned above, worm gear 30 is supported at an oblique angle on guide member 32 which angle will preferably be such as to align the teeth of worm gear 30 with teeth 38 of rack 34. Preferably both rack teeth 38 and the meshing teeth of worm gear 30 will be positioned perpendicular to the direction of movement of the window so as to minimize the forces transmitted through the worm gear 30 due to the weight and/or pressure of the window.

As previously mentioned, worm gear 30 is supported on guide member 32 which is provided with a generally rectangular shaped obliquely extending opening 49 through which worm gear 30 projects. Guide member 32 also has a vertically extending slot 50 provided therein of a cross-sectional shape substantially identical to the cross-sectional shape of rack 34 and through which rack 34 extends so as to place teeth 38 provided thereon in meshing engagement with worm gear 30. A notched portion 52 is provided along the backside of slot 50 in which is disposed an adjustable member 54 adapted to engage rear wall portions 44 and 46 of rack 34 so as to control and maintain the mutual engagement of worm gear 30 and teeth 38. A threaded member 56 is provided having an inner end extending through and supporting adjustable member 54 which is adapted to move member 54 into or out of slot 50.

Figure 1A:
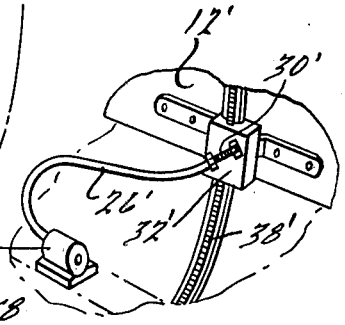
FIG. 1*a* is a perspective view similar to that of FIG. 1 but illustrating a window drive mechanism directly coupled to a motor.
Figure 2:
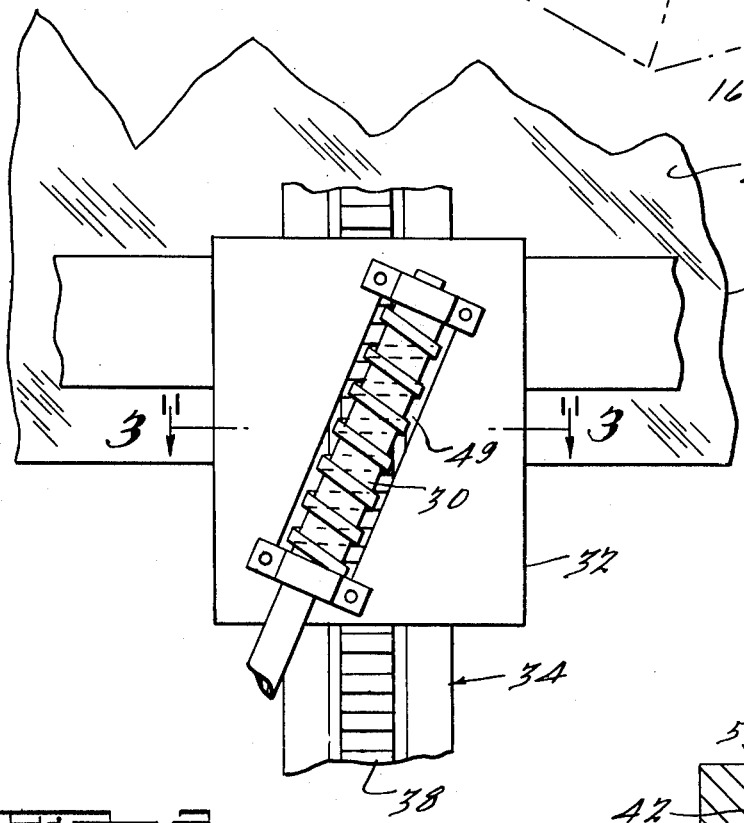
FIG. 2 is an enlarged fragmentary view of a portion of the drive mechanism illustrated in FIG. 1.

Guide member 32 is secured to the inner surface 58 of window 12 adjacent the lower edge thereof. Thus, as electric motor 16 is actuated, the rotational forces will be transmitted through flexible drive shaft 18, ring gear 20, flexible drive shaft 26 to worm gear 30 thereby causing worm gear 30 to move along rack 34. As worm gear 30 is secured to guide member 32 which in turn is secured to window 12, window 12 will be raised or lowered depending on the direction of rotation of electric motor 16. Alternatively, as illustrated in FIG. 1*a*, motor 16' may be directly connected to worm gear 30' by means of flexible drive shaft 26'.

Figure 1B:
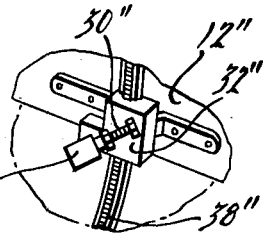
FIG. 1*b* is a perspective view similar to that of FIGS. 1 and 1*a* but illustrating the window drive mechanism supported upon a portion of the window.
Figure 3:
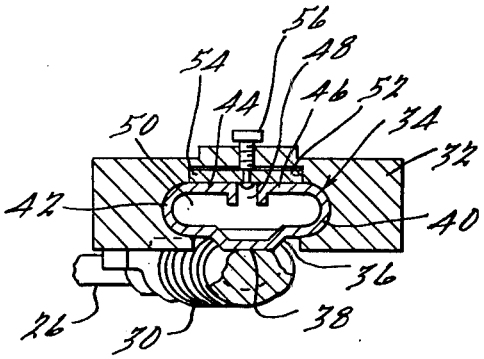
FIG. 3 is a sectional view of the drive means illustrated in FIG. 2, the section being taken along line 3—3 thereof.

Additionally, as illustrated in FIG. 1*b* should it be desirable, flexible drive shaft 26 may be entirely eliminated. In this embodiment, a modified guide member 32'' is provided secured to a portion of window 12'' which includes a worm gear 30'' operatively engaging a rack 38'' and having reversible electric drive motor 16'' secured thereto and directly drivingly connected to worm gear 30''.

It should also be noted that guide member 32 may be secured either directly to the glass portion of window 12 in any suitable manner such as by the use of adhesives or suitable fasteners or alternatively it may be secured to a lower window support frame.

As previously mentioned, should the individual prefer manually operated windows, ring gear 20 may be provided with crank means such as is illustrated in FIG. 4 and indicated generally at 58. Crank means 58 comprises a crank handle 60 secured to a shaft 62 to which ring gear 64 is secured. A flexible drive shaft 66 with a pinion gear 68 in meshing engagement with ring gear 64 is provided to transmit rotational forces from handle 60 to a worm gear drive means such as that described above. In order to prevent the weight of window 12 from transmitting rotational forces back through crank handle 60, biasing means in the form of a coil spring 70 may be provided coaxially with shaft 62.

Referring now to FIG. 5, another embodiment of the present invention is illustrated indicated generally at 72 which is adapted to be operated in either an electric drive mode or a manual drive mode. Window regulator means 72 comprises a ring gear 74 secured to a shaft 76 and having axially facing teeth 78 provided around the periphery thereof. A flexible drive shaft 80 is provided with a pinion gear 82 for transmitting driving forces to a worm gear drive means such as described above.

Shaft 76 has a diametrically extending elongated slot 84 provided therein adjacent ring gear 74 and a diametrically extending pin 86 extending therethrough at a point approximately midway along its length. A drive gear 88 is also slidably mounted on shaft 76 and has an axially extending annular flange portion 90 provided on one side thereof through which a pin 92 extends. Pin 92 also extends through slot 84 so as to prevent rotation of drive gear 88 with respect to shaft 74 but is axially slidable within slot 84 so as to allow gear 88 to be axially movable between a first and second position. A pinion gear 94 is secured to one end of a flexible drive shaft 96, the other end of which is connected to a reversible electric drive motor 98. Pinion gear 94 and drive gear 88 are positioned so as to meshingly engage each other when drive gear 88 is in a first position and to be spaced when drive gear 88 is in a second position. Biasing means in the form of a helical compression spring 100 is provided extending between surface 102 of ring gear 74 and surface 104 of drive gear 88. Thus, when drive gear 88 is in a first position, window regulator means 72 is in a first operational mode in which the window will be driven by reversible electric motor 98.

In order to provide a second manual operational mode for window regulator means 72, a handle 106 is also provided which is axially slidable with respect to shaft 76. Handle 106 includes an axially extending annular flange portion 108 having axially extending diametrically opposed slots 110 and 112 provided therein which are adapted to be moved into registration with pin 86 when handle 106 is moved axially along shaft 76 to the right as illustrated. Additional biasing means are provided in the form of a helical coil compression spring 114 coaxial with shaft 16 and extending between surface 116 of drive gear 88 and surface 118 of handle 106 which operates to bias handle 106 into a first position in which it is free to rotate with respect to shaft 76. A suitable fastening means such as screw 120 and washer 122 are also provided to retain handle 106 on shaft 76.

Thus, when handle 106 and drive gear 88 are in respective first positions, electric drive motor 98 will be operably coupled to drive ring gear 74 thereby providing a first operational mode. However, should an electrical failure be encountered or electric drive motor 98 fail to operate, handle 106 may be moved axially along shaft 76 thereby moving slots 110 and 112 into engagement with pin 86 thereby enabling rotation of handle 106 to impart rotational movement to ring gear 74. As handle 106 is moved further along shaft 76, surface 124 of annular flange portion 108 will engage surface 116 of drive gear 88 causing it to move axially along shaft 76 out of engagement with pinion gear 94 thereby allowing rotation of drive gear 88 without also requiring rotation of drive motor 98. Thus, window regulator means is provided with a second manual operational mode which may be easily utilized until such time as repairs to the electrical drive means can be effected.

In certain applications, the available space for accommodation window regulator and drive means is extremely limited. This space limitation or other reasons may prohibit mounting of the window regulator in a suitable position so as to avoid sharp bends in the flexible drive shaft over the entire travel of the window. Accordingly, a tracking means is provided and will be described with reference to FIGS. 6 and 7. In this embodiment window regulator means 126 are provided which compromise a ring gear 128 having axially facing teeth 130 provided around the periphery thereof which engage a pinion gear 132 secured to one end of a flexible drive shaft 134 all substantially identical to that described above. Suitable ring gear drive means may be provided such as handle 136 or alternatively an electric drive arrangement such as described above. However, in this embodiment, pinion gear 132 and associated flexible drive shaft 134 are movably mounted on a pinion pivot arm 138 which is rotatably secured to the center of ring gear 128. A second pinion gear 140 is also provided secured to a shaft 142 rotatably supported on pinion pivot arm 138. A step gear 144 is also fixedly secured to shaft 142 and adapted to be driven by the engagement of pinion gear 140 with ring gear teeth 130. An acuate shaped rack 146 is provided having teeth in meshing engagement with step gear 144 which rack is fixedly secured to a suitable portion of the door or associated framework. Step gear 144 will preferably be of a diameter relative to pinion gear 140 so as to provide a suitable reduction ratio such as for example 20:1. Thus, assuming the window regulator and drive arrangement requires five full revolutions of ring gear 128 to move the window from a fully open to a fully closed position, step gear 144 will cause pinion pivot arm 138 to index through 90°. It should be noted that the ratio may be suitably varied to provide any desired ratio for the particular application.

A preferred embodiment is illustrated and will be described with references to FIGS. 8 through 11. Referring specifically to FIG. 8, there is shown another embodiment of a window drive portion of the present invention which comprises a guide means in the form of a generally triangularly shaped member 148 which is secured to an inner surface 150 of window 152 adjacent a lower edge thereof. This generally triangularly shaped member will preferably be fabricated from a plastic composition and includes a perimeter reinforcing flange 154 extending therearound. Flange 154 extends outwardly at a point along the upper portion so as to provide an opening 156 therethrough which opening is defined by substantially parallel opposed sidewall portions 158 and 160 with an interconnecting arcuate shaped outer portion 162. Opening 156 is adapted to accommodate a rack in the form of a rod 164 having teeth 166 provided along one longitudinally extending surface thereof. A similar opening 168 is provided along the lower portion as best seen with reference to FIG. 11. In order to retain rod member 164 in position within these openings sidewalls 158 and 160 are provided with slots 169 which are adapted to receive edges of a generally rectangularly shaped member 170. An acuate shaped notch 172 is provided in the outwardly extending edge of member 170 and serves to engage rod member 164 so as to retain it in position between notch 172 of member 170 and interconnecting portion 162. A worm gear 174 is secured to surface 176 of member 148 at an oblique angle relative to rod member 164 and is positioned in meshing engagement with teeth 166 of rod 164. Preferably the teeth provided on the worm gear drive member will have a pitch relative to the angle of mounting such that they will be substantially parallel to the teeth provided on the rack member so as to thereby effectuate a smooth vibration-free operation of the window itself. As seen in FIG. 10, worm gear drive 174 is secured to an end portion of a flexible cable 178 comprising a flexible drive shaft 180 having a generally rectangularly shaped end portion 182 which fits within an opening 184 provided in worm gear drive 174 and an outer sheath 186 within which flexible drive shaft 180 is adapted to rotate. A pair of bearing blocks 188 and 190 are provided for supporting worm gear drive 174 on surface 176 relative to the rod member 164.

Thus, as is apparent the present invention as embodied in FIGS. 8 through 11 provides a unique flexible cable drive means for raising and lowering a motor vehicle window which operation is greatly facilitated in that the cable is mounted at an oblique angle relative to the travel of the window member itself. This mounting arrangement insures that only a minimal amount of bending action will be exerted on the cable thus avoiding any possibility of the flexible cable being kinked or otherwise rendered inoperative. Further, in that the inclination of the worm gear drive member will be in a direction such that the cable feed is angled toward the window regulator a shorter length of cable may be provided thereby reducing the cost of such drive mechanisms.

A preferred embodiment of a window regulator in accordance with the present invention is illustrated and will be described with reference to FIGS. 12 and 13. Window regulator in accordance with the present invention is indicated generally at 192 and comprises a ring gear 194 in the form of a disc having axially facing gear teeth 196 provided on a peripheral annular flange portion 198. A generally rectangularly shaped central opening 200 is provided which is adapted to receive a portion of a drive shaft 202 having a square end portion 204 so as to prevent relative rotation therebetween. A cable support member 206 of a diameter slightly greater than the diameter of ring gear 194 is also provided having a generally circular shape so as to surround and enclose teeth 196 of ring gear thereby providing protection thereto against dirt, debris, or other contaminents which could clog or otherwise jam or make operation of the regulator difficult. A flexible drive cable 208 is supported within cable support housing 206 and has a pinion gear 210 provided on the inner end thereof. Ring gear 194 is positioned in such a manner as to place teeth 196 in meshing engagement with pinion gear 210. Suitable bearing blocks 212 and 214 are provided for supporting the pinion gear within the cable support housing.

Drive shaft 202 as previously mentioned has a square end portion 204 adapted to drivingly engage opening 200 provided in ring gear 194. Shaft 202 also includes a generally cylindrically shaped mid-portion 216 adapted to be rotatably supported in opening 217 provided in cable support member 206. A splined end portion 218 is also provided which is adapted to receive a handle 220 for rotatably driving ring gear 194. Handle 220 may be easily secured in the conventional manner such as by split ring fastener 222 and suitable washers 224 and 226 may also be provided to facilitate rotation of the shaft relative to cable support member 206.

Preferably, the ring gear and cable support member will both be fabricated from a plastic composition and accordingly in order to reduce material thicknesses so as to minimize the weight of the assembly as well as to reduce the overall cost thereof, ring gear 194 and cable support member 206 are designed with interengaging portions as illustrated in FIG. 13 which portions serve to minimize the distortion of the ring gear as the rotational forces are transmitted thereto via the handle 220 and associated drive shaft 202. Accordingly, ring gear 194 is provided with a generally cylindrical projection 228 extending axially outward from the center thereof. A recess portion 230 is provided at the outer end thereof which is adapted to receive a similar cylindrical projection 232 extending axially outward from cable support member 206. A mating annular recess 234 is provided on cable support member 206 being defined in part by cylindrical projection 232 and in part by annular flange portion 236. Thus, cylindrical projections 228 and 232 are designed to nest together so as to reinforce and stabilize the ring gear relative to the flexible cable support member. This thereby insures that ring gear teeth 196 will properly engage the pinion gear provided on the flexible cable drive member as well as insuring that the drive shaft will be adequately supported with respect thereto. Thus, the forces will be transmitted via the crank handle through the drive shaft to the ring gear housing which will impart rotational movement to the ring gear which in turn transmits these forces to the pinion gear and via the flexible cable to the associated window drive mechanism such as described above. It should also be noted that while the preferred manual version is illustrated as described above, the pinion pivot arm described with reference to FIG. 6 as well as the dual mode operation crank handle and electrical motor drive arrangement described with reference to FIG. 5 may be easily incorporated herein as well.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. A window regulator for operating an automobile window comprising:

a shaft;

a ring gear fixedly secured to one end of said shaft;

a drive gear slidably supported on said shaft and axially movable between first and second positions;

a handle slidably supported on said shaft adjacent another end and axially movable between first and second positions; and drive means operative to drive said drive gear when said drive gear is in said first position;

first biasing means for urging said drive gear into said first position;

second biasing means for urging said handle into said first position;

said regulator having a first operational mode in which said handle and said drive gear are in said first positions and said drive gear cooperates with said drive means to rotate said ring gear and said handle is inoperative to drive said ring gear and a second operational mode in which said drive gear and said handle are in said second position and said handle is operative to drive said ring gear and said drive gear is moved out of engagement with said drive means.

2. A window regulator as set forth in claim 1 wherein said first biasing means comprising a helical coil spring extending between said ring gear and said drive gear and said second biasing means comprises a helical coil spring extending between said drive gear and said handle.

3. A window regulator as set forth in claim 1 wherein said handle is positioned in axial spaced relationship to said drive gear when in said first position.

4. A window regulator as set forth in claim 1 wherein said handle is rotatable with respect to said shaft when in said first position.

5. A window regulator as set forth in claim 4 where in movement of said handle is from said first position to said second position also causes said drive gear to move from said first position to said second position.

6. A window regulator as set forth in claim 5 wherein said drive means comprises a reversible electric motor operatively connected to said drive gear, said electric motor being operative to vary the position of said window when said regulator is in a first operational mode.

7. A window regulator as set forth in claim 6 wherein said electric motr is operatively connected to drive said drive gear by a flexible drive shaft.

8. A window regulator as set forth in claim 1 further including means for preventing relative rotation between said drive gear and said shaft.

9. A window regulator as set forth in claim 8 wherein said shaft includes a diametrically extending axially elongated slot and said relative rotation preventing means comprise a pin member extending through said slot.

10. A window regulator set forth in claim 1 wherein said shaft includes means engageable by said handle operative to prevent relative rotation between said handle and said shaft when said handle is moved into said second position.

11. A window regulator set forth in claim 10 wherein said engageable means comprises a pin member extending radially outwardly from said shaft.

12. A window regultor as set forth in claim 10 wherein said handle includes an axially elongated radially extending slot operative to receive said engageable means when said handle is moved into said second position.

* * * * *